US006545415B1

(12) United States Patent
Ward

(10) Patent No.: US 6,545,415 B1
(45) Date of Patent: Apr. 8, 2003

(54) HIGH EFFICIENCY HIGH VOLTAGE LOW EMI IGNITION COIL

(76) Inventor: Michael A. V. Ward, c/o Combustion Electromagnetics, Inc., 32 Prentiss Rd., Arlington, MA (US) 02476

( * ) Notice: Subject to any disclaimer, the term of this patent is extended or adjusted under 35 U.S.C. 154(b) by 157 days.

(21) Appl. No.: 09/714,597

(22) Filed: Nov. 16, 2000

Related U.S. Application Data

(60) Provisional application No. 60/165,790, filed on Dec. 27, 1999.

(51) Int. Cl.[7] ..... H01J 13/46
(52) U.S. Cl. ..... 315/56; 123/604; 123/634
(58) Field of Search ..... 315/56, 57; 123/594, 123/604, 606, 621, 634; 336/15, 221, 222

(56) References Cited

U.S. PATENT DOCUMENTS 4,352,079 A * 9/1982 Mueller et al. ..... 336/107
5,947,093 A * 9/1999 Ward ..... 123/169 EL

* cited by examiner

*Primary Examiner*—Don Wong
*Assistant Examiner*—Thuy Vinh Tran
(74) *Attorney, Agent, or Firm*—Jerry Cohen; Perkins, Smith & Cohen

(57) ABSTRACT

A high efficiency high voltage ignition coil with segmented high voltage bobbin (15) with the last few bays (16,17,18) having fewer secondary winding turns than the average and thicker flanges separating the bays, and further including an inductor (20) of inductance at least 0.5 mH with a core material which is lossy in the 100 KHz to 1 MHz range, the inductor located between the end of the high voltage winding and the spark gap (*7b*) so as to reduce the peak voltages across the last few high voltage bays immediately following the spark gap breakdown.

16 Claims, 4 Drawing Sheets

HIGH EFFICIENCY HIGH VOLTAGE LOW EMI IGNITION COIL

FIELD OF THE INVENTION

This application claims the benefit of 60/165,790 filed Dec. 27, 1999.

This invention relates to ignition coils for internal combustion (IC) engines, both capacitive discharge (CD) and inductive. In particular, it relates to modern ignition coils with segmented bobbins in which the secondary winding is wound in separate bays, and more particularly to high efficiency ignition coils, both CD and inductive, which have a low secondary resistance typically in the 100 to 500 ohm range and use spark plug wires and spark plugs with direct current (DC) resistance substantially less than 1000 ohms. The invention addresses issues of transient high voltage resulting from ignition spark firing of such high efficiency coils, in particular issues associated with the high voltage spark discharge as it reflects itself in the ignition coil high voltage "end-effects" and electromagnetic interference (EMI). In addition, this invention relates to systems for fabricating and encapsulating such high efficiency coils with the improvements made to resolve the end-effect and EMI issues consistent with a coil structure that is not susceptible to high voltage corona discharge or to cracking from temperature variations which may result from the designs.

BACKGROUND OF THE INVENTION AND PRIOR ART

Current CD and inductive ignition systems are very inefficient, with secondary winding resistance in the thousands of ohms, and typically using spark plug wire with resistance in the 5,000 to 10,000 ohms per foot, and resistive spark plugs which typically have resistance of about 5000 ohms. These high resistance values serve to reduce EMI associated with the spark firing, which occurs when the various ignition secondary circuit capacitances discharge from their initial high voltages of typically 8 to 24 kilovolts (kV), to close to ground potential when the spark is formed. In addition, the high secondary resistance allows the voltage at the ignition coil high voltage tower to decrease relatively slowly and smoothly so that the voltage distribution across the coil secondary windings following spark firing is relatively smooth and low. In particular, in the case of a modern segmented bobbin with a total wire plus plug resistance of 10,000 to 20,000 ohms, the voltage drop across the last bay is limited to a small fraction, typically ⅕ to ⅓ the coil peak output voltage Vs which, with proper design and high voltage isolation margins for the more limited peak voltage Vs, will not cause breakdown across the last bay of the coil to damage the coil.

On the other hand, for very high efficiency ignition systems, the voltage across the last bay of the coil secondary winding can be equal to and even greater than the voltage Vs. Two such very high efficiency ignitions are the inductive 42 volt based ignition disclosed in my prior patent application PCT/US96/19898, filed Dec. 12, 1996, (WO 97/21920. Jun. 19, 1997 publication date), and the CD based ignition disclosed in my U.S. Pat. No. 5,947,093, issued Sept. 7, 1999. Their secondary winding resistances are very low, typically 100 to 200 ohms for the CD version, and about 500 ohms for the inductive version, with the constraint that non-resistive spark plugs are used as well as low resistance inductive suppressor wire with DC resistance typically less than 50 ohms per foot for the CD system and less than 500 ohms per foot for the inductive system.

Such high efficiency coil structures are susceptible to electrical breakdown across their last secondary winding bay upon ignition firing at a preferred high breakdown voltage of 30 to 40 kV. In fact, the coil may survive open circuit peak voltages Vs of 42 kV (where the end effect is not present or diminished), and fail by electrically breaking down across the last bay at a lower breakdown voltage following spark formation. Associated with the spark breakdown in such high efficiency ignition structures is higher than normal EMI and greater susceptibility to corona if the entire coil is not encapsulated given the preferred higher peak output voltages Vs of approximately 42 kV, as disclosed in my previous U.S. Provisional Patent application No. 60/142,008, filed Jul. 1, 1999. However, it is not industry practice to encapsulate the entire coil structure because of the large differences in expansion coefficient between the magnetic laminations and copper wire and the bobbin and the encapsulant (usually an epoxy).

This patent application discloses method and apparatus for reducing, to acceptable levels, the ignition coil high voltage spark firing end-effect found in high efficiency ignition systems and for reducing the associated EMI. With such method and apparatus is also disclosed modifications made to the secondary winding bobbin, of a segmented bobbin design, to further reduce the end-effect. Also disclosed is complete ignition coil structures, both CD based and special high efficiency 42 volt based inductive, incorporating such improvements in the form of complete encapsulated structures designed to also minimize high voltage corona and to be less susceptible to cracking under temperature extremes.

SUMMARY OF THE INVENTION

One aspect of invention is the discovery/conclusion that with each inductive bay winding "Li" in a segmented bobbin there is associated a response time "Tri", which I define as the time it takes for the voltage across a given bay, particularly across the last or "nth" bay, to respond to a sudden change in peak output voltage Vs of the coil (going from a voltage Vs to ground in the order of a few nanoseconds). This response time Tri is typically in the range of 100's of nanoseconds (nsec), representing a frequency of the order of a few MegaHertz (MHz), and is a function of the number of turns in the bay, among other things. Having drawn the conclusion on Tri, one embodiment of the invention includes a special high dissipation, low capacitance inductor "Lend" located at the high voltage end of the coil that slows the discharge of the coil output capacitance Cs upon spark firing to a long discharge time period "Tc", significantly longer than Trn (Tri for the last bay). The design of the last few bays is preferably modified (e.g. relatively fewer turns) to further accentuate the difference between the times Tc and Trn, giving the voltage across the last bay more time to track the change in voltage Vs(t) to minimize the voltage difference $\Delta Vsn(t)$ across the last bay (with acceptably low voltage differences across each of the next two adjacent bays). In this way, the voltage difference across the last bay (and its adjacent one or more bays) is reduced to a level that will not cause electrical breakdown across the bays.

Another aspect of the invention is the design of a high dissipation, low capacitance inductor Lend for reducing the high voltage end-effect by slowing down and attenuating the discharge of the high voltage coil output capacitance Cs (upon spark firing). Preferably, the inductor has an inductance Lend in the range of 1 to 10 mH, depending on the coil structure it is used with, and uses magnetic core material that is low dissipation below 50 kHz and high dissipation in the range of 200 kiloHertz (kHz) to 2 MHz, e.g. Philips ferrite material E5, E6, E7, E25, Fair-Rite material 75, 76, 77, etc. A preferred embodiment of the inductor Lend is a coaxial inductor with open ends with a well insulated single layer winding of wire over an inner core of typical diameter between ¼ and ½ inches surrounded by an outer tubular magnetic core of typical outer diameter of ½ to 1 inch. The inductor preferably uses 100 to 500 turns of magnet wire of American Wire Gauge (AWG) between 30 and 40 with heavy insulation, preferably Teflon, wound over a length of 1 to 6 inches for convenient location either integrated within the coil high voltage tower or located externally on top of the high voltage tower. The inductor may use several different materials for the inner and outer magnetic cores.

The end-effect suppression inductor Lend performs two functions during the spark breakdown: 1) it presents a sufficiently high inductance and sufficiently low shunt capacitance to limit the amplitude of the high frequency components associated with the spark breakdown and slow the discharge of the coil output capacitance Cs to a period of about 1 microsecond or greater, and 2) it provides sufficient dissipation to limit, or essentially eliminate, the overshoot of the high voltage discharge of the output capacitance Cs.

Preferably, the inductor Lend is located within the high voltage tower, preferably at right angles to the axis of the coil bobbin to provide the maximum length of inductor consistent with maintaining a compact coil structure. This is particularly suitable for the 42 volt based inductive ignition already mentioned (patent cited) where the inductor is conveniently placed at the open end of the open magnetic E-core of the coil. Preferably, for both CD and inductive designs, the entire coil, including most of the lamination structure, is encapsulated to minimize chances for high voltage corona breakdown due to the preferred higher voltage operation of the coil, i.e. firing at up to 36 kV versus the typical 24 kV for industry coils. The encapsulation, e.g. epoxy, is preferably highly filled with low expansion coefficient material, e.g. alumina powder, to reduce the expansion coefficient to under 30 PPM/°C. (parts per million per degree Celsius), and to maximize the thermal conductivity. Also, preferably low expansion coefficient bobbin material is used, such as General Electric Noryl (modified phenylene oxide) with 30% glass filing. Alternatively, the secondary winding may be wound using a universal winding machine to produce free standing separate sections (called pi windings).

Preferably, low resistance, high frequency, inductive suppression spark plug wire is used of resistance under 100 ohms/foot, preferably about 10 ohms/foot, with an inductance of about 100 microHenries (uH)/foot achieved by winding 32 to 38 AWG copper wire on a magnetic core (typically ferrite) of at least 0.1" diameter. This offers good EMI suppression, with minimum efficiency loss of the coil, in the range of 10 to 100 MHz, where the end-effect inductor Lend is not normally effective due to its stray (shunt) capacitance.

As used herein, the term "about" means between 0.5 and 2 times the value it qualifies and "approximately" means within ±25% of the term it qualifies.

For ignition coils used in a 42 volt based inductive ignition which preferable use coils with open magnetic cores, especially of an open-E type core, a preferred design for the preferred high voltage segmented bobbin is to have the bobbin extend beyond the open end of the magnetic core such that the last few flanges, e.g. two or three flanges can be made of larger diameter, since they are not confined by the two outer legs of the open-E core. Preferably the slot or bay width of these is made much narrower to keep the number of turns relatively low to the previous bays. The result will be lower end-effect voltages across these last few bays and a deeper winding (winding height) to handle the expected higher voltage.

As complete systems, my high efficiency CD and 42 volt based inductive ignitions represent the highest energy, highest efficiency, and lightest weight of all known ignition systems, and are now improved to also provide the highest peak output voltage Vs for a given size coil and ignition system efficiency, with the lowest EMI when used with good, low resistance inductive suppression spark plug wire, and with capacitive spark plugs with inductive suppressors. As complete ignition systems, they also provide the most effective ignition spark, with flow-resistant peak spark current of 300 to 600 ma, spark energy of about 100 millijoules (mJ), with battery to spark efficiency of 50% to 60%, and now with peak output voltage of approximately 42 kV without fear of breakdown due to end-effect.

DESCRIPTION OF PREFERRED EMBODIMENTS

Figure 1:
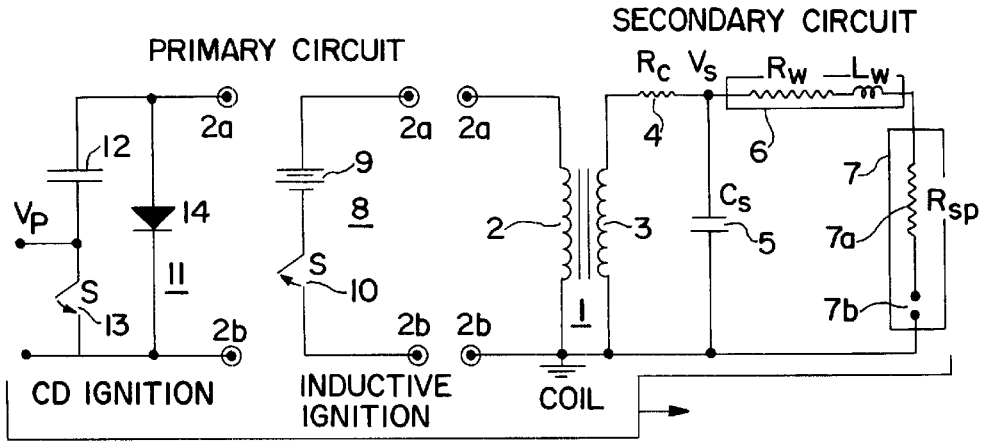
FIG. 1 is a circuit diagram of an ignition system depicting a secondary circuit with a single coil 1, with either of two basic forms of primary circuit, an inductive ignition circuit and a CD circuit, shown connected to the coil terminals of the secondary circuit.

FIG. 1 is a circuit diagram of an ignition system depicting a secondary circuit with a single coil 1 with primary winding 2, secondary winding 3, coil secondary resistance 4 (resistance Rc), coil output capacitor 5 (capacitance Cs), and completing the secondary circuit is spark plug wire 6 (with resistance Rw and inductance Lw), and the spark plug 7 with resistor 7*a* (resistance Rsp) and spark gap 7*b*. Connected to the primary terminals 2*a* and 2*b* of the coil 1 are shown the two basic forms of primary circuit, an inductive ignition circuit 8 with battery 9 and switch 10 (normally closed switch S), and a CD ignition circuit 11 with capacitor 12 charged to a voltage Vp, switch 13 (normally closed switch S), and shunt diode 14 shown in the preferred mode shunting the primary coil winding 2. The operations of these two circuits is well known to those versed in the art and is disclosed in the cited patents and patent applications.

Typically, the spark plug wire resistance Rw is 5,000 to 10,000 ohms per foot and the spark plug resistance Rsp is 5,000 ohms. This results in a secondary circuit resistance of 10,000 to 20,000 ohms, which with an assumed secondary circuit output capacitance Cs of 30 pF, gives an RC time constant of 0.3 to 0.6 microseconds, and a discharge time Tc of about 1 to 2 microseconds, i.e defined as the time for capacitor Cs to discharge from a voltage Vs to approximately 1/10th of Vs. This results typically in an end effect voltage (voltage difference ΔVsn across the last bay for a segmented bobbin) of about 1/3 of Vs, which is a value that can be handled with proper design, especially for the lower peak voltages of 24 kV for current ignition systems.

Figure 2:
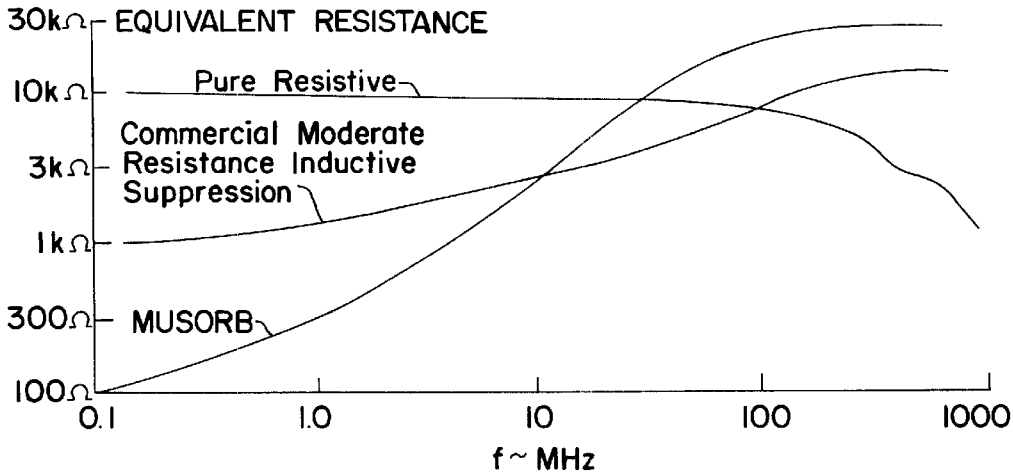
FIG. 2 depicts the (equivalent) resistance as a function of frequency of three different secondary circuit resistances, for the frequency range from 0.1 to 1000 MHz.

FIG. 2 depicts the (equivalent) resistance as a function of frequency of three different secondary circuit resistances, for the frequency range from 0.1 to 1000 MHz. Included is the above mentioned, largely frequency independent "Pure Resistive" circuit of 10,000 ohms, and two more modem, low resistance, inductive wound high frequency suppression wires. The better of these high frequency suppression wires is MUSORB, which features the highest equivalent resistance of approximately 30 kilohms in the frequency range of 100 to 1000 MHz. Shown also is a "Commercial Moderate Resistance Inductive Suppression" wire of the type used in Europe and in special applications in the U.S. A key point to appreciate is that at the frequency associated with the end effect, i.e. of order 1 MHz, these high frequency suppression wires have a low equivalent resistance. The reason for this low resistance (attenuation) at this frequency is three-fold: 1) the wires do not have sufficiently high density of ferrite material in their core, with typical relative permeability of 5 to 20; 2) the ferrite material they use is a high frequency material most effective in the 30 to 1000 MHz range; and 3) the winding structure they use is of low inherent inductance, i.e. loosely wound single layer winding with small winding diameter of typically 0.05 to 0.15 inches.

Figure 3:
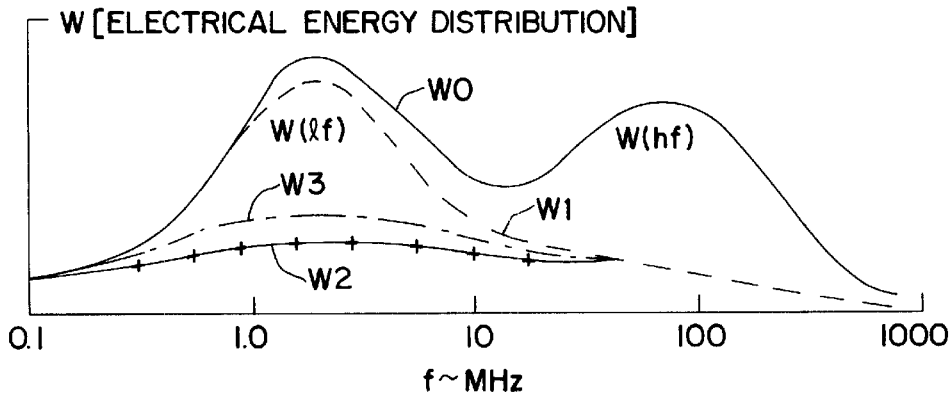
FIG. 3 depicts the typical electrical energy distribution W associated with spark firing, well above the low frequency where most of the spark energy is discharged (usually below 20 kHz).

In FIG. 3 is shown the typical electrical energy distribution W associated with spark firing, well above the low frequency where most of the spark energy is discharged (usually below 20 kHz). The solid curve, W0, represents the un-attenuated electrical energy, which is shown to have two major components. One is a lower frequency component W(lf) which peaks in the low MHz range (2 to 5 MHz) for low secondary circuit inductance, and is due to the discharge of the coil output capacitance. The other is a high frequency component W(hf) which peaks in the high MHz range (30 to 300 MHz) and is due to the discharge of the various stray output capacitances, especially found in ignition systems with high voltage distributors.

The energy distribution curve W1 (dashed curve) represents the action of a good quality inductive suppression wire such as MUSORB, which is shown to substantially reduce the high frequency component W(hf) but to have essentially no effect on the low frequency component W(lf). The curve W2 (dashed plus crosses) represents the effect of resistive wires and plugs of resistance of about 20 kilohms, which has good suppression across the frequency spectrum (but also substantially reduces the spark energy). Curve W3 (dashed plus dots) represents the desired effect of the combination of the end effect inductor Lend and good quality inductive suppression wire. The level W3 at the lower frequency end is shown somewhat higher than the level associated with the high resistance, and it will vary depending on the specifics of the design for Lend.

Figure 4A:
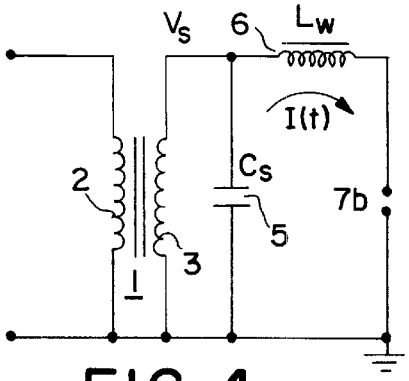
FIG. 4*a* depicts the secondary circuit of the preferred high efficiency ignitions cited.
Figure 4B:
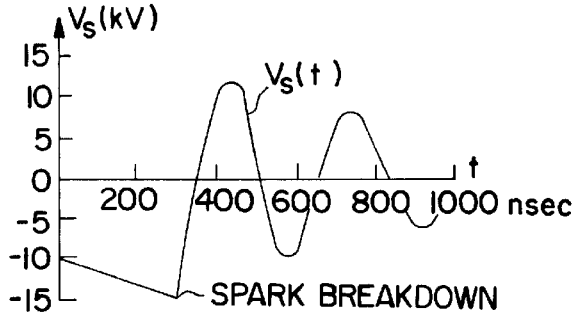
FIG. 4*b* depicts the voltage waveform immediately following spark firing at the high voltage end of the ignition coil.

In FIG. 4*a* is shown the secondary circuit of the preferred high efficiency ignitions cited. Like numerals represent like parts with respect to the earlier figures. Note the absence of the coil secondary resistance Rc (which is well below 1000 ohms) and wire resistance Rw. The circuit is drawn to show the effect of the spark breakdown process when the coil output capacitance Cs (5) discharges with a current I(t) through the spark gap 7*b*. The resulting voltage waveform is shown in FIG. 4*b*, where the voltage in this example is shown to reach a level of −15 kV (at an arbitrary time of 300 nanoseconds), when the spark gap 7*b* breaks down. The voltage Vs(t) then oscillates to a positive value almost equal in magnitude to the initial value (−15 kV) with a period determined by the output capacitance Cs and the circuit inductance, which for typical inductance suppression wire is a few hundred microHenries, depending on the wire and its length. The voltage waveform is only weakly attenuated due to the low resistance of the preferred high efficiency circuit.

Figure 5A:
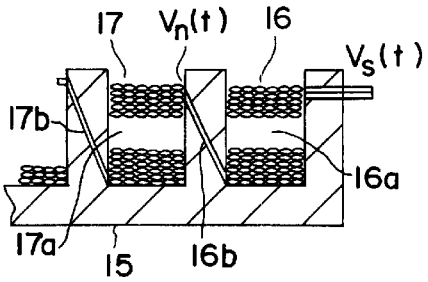
FIG. 5*a* shows a not-to-scale partial side view of the end of the secondary coil windings of a segmented bobbin with the last two bays shown with their windings.
Figure 5B:
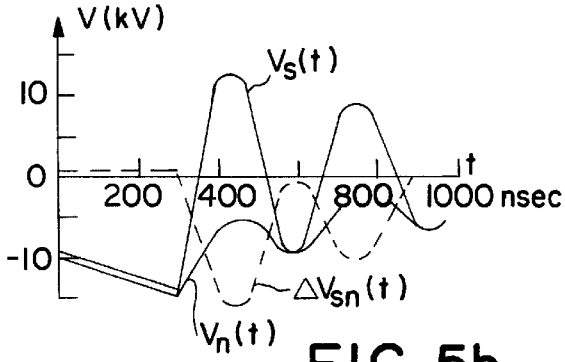
FIG. 5*b* depicts the voltage waveform immediately following spark firing at the high voltage end of the ignition coil, at the end of next most inner bay, and across the flange separating the last two bays.

From the perspective of the secondary coil windings of a segmented bobbin whose high voltage end 15 is shown in partial side-view in FIG. 5*a*, the voltage Vs(t) at the high voltage winding end takes a large voltage excursion upon spark breakdown, as shown in FIG. 4*b* and duplicated in FIG. 5*b*. In FIG. 5*a*, the last two bays 16 and 17 of the bobbin 15 are shown with their respective windings 16*a* and 17*a* with respective wires 16*b* and 17*b* interconnecting the bays, as is normally done and is known to those versed in the art.

The main point of this drawing is that the voltage Vn(t) at the bottom of the last bay 16 (also at the top of bay 17) is not able to track the voltage change Vs(t). In fact, it can be given a response time Trn, which is typically in the hundreds of nanoseconds time duration (for responding to an abrupt change in the output voltage Vs(t)). This lag in voltage Vn(t), shown in FIG. 5*b*, results in a voltage difference ΔVsn(t) across the last bay which can exceed the peak voltage Vs, i.e. exceed the 15 kV as is indicated by the dashed curve in FIG. 5*b*. That is, the entire output voltage (in principle close to twice the output voltage) can appear across the last bay in the case of very high efficiency discharge circuits to damage the coil by producing electrical breakdown across the last bay.

Figure 6A:
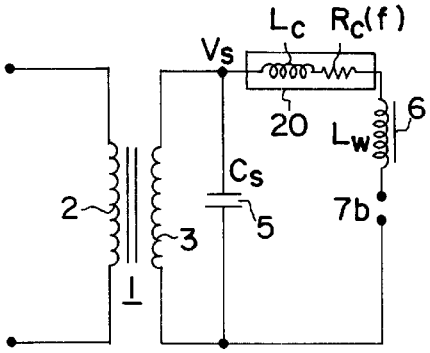
FIG. 6*a* depicts the secondary circuit of the preferred high efficiency ignitions as in FIG. 4*a* but also including the end-effect inductor shown as a series inductor and frequency dependent resistance.

There are two parts to the solution of this problem. One part involves using an attenuating end-effect inductor 20 (Lend) interposed between the high voltage output Vs and the inductive suppression wire 6 of FIG. 4*a*, as indicated in FIG. 6*a*. The second part of the solution involves modification to the bobbin, as is shown with reference to FIG. 7.

Figure 6B:
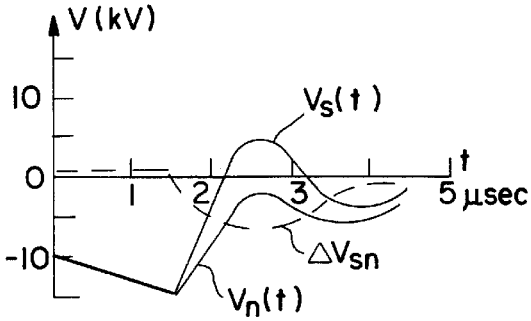
FIG. 6*b* depicts the same voltage waveforms as in FIG. 5*b* except now modified by the action of the end-effect inductor.

In FIG. 6*a* like numerals represent like parts with respect to the earlier figures. The end-effect inductor 20 is shown represented by an inductance Lc and a frequency dependent resistor Rc(f). This inductor can be placed anywhere in the secondary circuit, but more ideally it is either integrated into the coil, i.e. encapsulated into the high voltage tower (shown in FIGS. 8*a* and 9*a*), or mounted externally onto the coil high voltage tower, or both. It is made of an inductive winding with typical low-frequency inductance of 1 to 10 mH with magnetic material which is attenuating at about 1 MHz, i.e. where the imaginary part $\mu i$ of the permeability is about equal to the real part $\mu r$ at about 1 MHz. In operation, the inductor slows down discharge of the output capacitance Cs as per FIG. 6*b* (note the time scale is five times longer than that of FIG. 5*b*) and attenuates the voltage Vs(t). The net effect is that the last bay winding voltage Vn(t) can more closely track the output voltage oscillatory decay Vs(t), i.e. there is a smaller phase shift. This results in a significantly reduced voltage difference ΔVsn(t) across the last bay (as is indicated by the dashed curve). The extent of the reduction depends on both the slowing down and attenuation of the discharge of the output capacitance Cs (voltage Vs(t)).

Figure 6C:
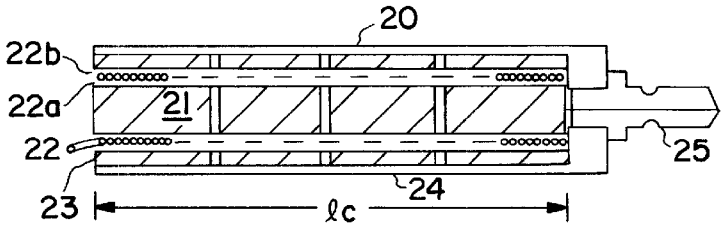
FIG. 6*c* depicts an approximately to-scale side-view drawing of an end-effect inductor made up of an open-end coaxial inductor.

FIG. 6*c* depicts an approximately to-scale side-view drawing of a preferred end-effect inductor 20 made up of an open-end coaxial inductor with inner cylindrical magnetic core 21, single layer wire winding 22 surrounded by low dielectric constant insulating layers 22*a*, 22*b*, outer tubular cylindrical magnetic core 23, outer insulating protective tube 24, and high voltage terminal 25. For any inductor, especially ones with high losses around 1 MHz which use Manganese-Zinc ferrite as the core, there can be a high shunting capacitance due to the very high permittivity (in the 100,000 range) of the ferrite. Therefore, care must be taken to reduce the capacitance to the level where it has a small effect on the output voltage Vs(t) following spark breakdown. This can be done having a relatively large, low dielectric constant spacing 22*a* and 22*b* between the wire layer 22 and the inner and outer cores. Also, and using low dielectric constant coating, e.g. Teflon, for the wire will somewhat reduce the capacitance, as well as using small lengths of the magnetic core cylinders 21, 23 (four shown for each) separated by small air-gaps, preferably filled with low dielectric constant material such as Teflon or polyethylene. The gaps in the cores also reinforce the two end-gaps to reduce the effective permeability to help prevent core saturation, but not to the point where the core losses are compromised. For the outer core 23, one may use a tubular material of a plastic or rubber matrix highly filled with ferrite (preferably highly lossy at 1 MHz), to give a moderate permeability, low capacitance, flexible material resistant to cracking through temperature induced expansion and contraction.

For an ignition coil with a segmented bobbin with an output capacitance Cs of 20 picofarads (pF) and assumed preferred inductance Lc of 2 milliHenry of inductor 20, the impedance ζ (equal to the square root of (Lc/Cs)) is 10 kohms, resulting in a peak discharge current Ic of 3.6 amps from discharge of capacitor Cs with initial voltage Vs of 36 kV (for assumed zero resistance Rc(f)). Assuming turns Nc for the winding 22 equal to 200, and a center core diameter of 0.4 inches (1 cm), then the peak magnetic flux density equals 0.45 Tesla. However, given the inclusion of Rc(f) the various other inductances and small losses, the peak current will be lower, which should prevent the inner core from saturating. A preferred design for the core diameters is approximately 0.4" (1 cm) for the OD of the inner core 21, and approximately 0.5" (1.25 cm) and 0.7" (1.75 cm) for the ID and OD respectively of the outer core 23. A preferred length of the core "lc" is about 2" (5 cm). However, these values depend on many variables, especially the core material used and spacings between the core parts, the constraints for placement of the inductor and its dimensions, use of one or two inductors, parameters of accompanying spark plug wires, coil output capacitance, expected peak voltages, and the parameters of the segmented bobbin itself. Ultimately, the design is selected within various constraints to limit the peak voltage difference ΔVsn across each of the last few bays to an acceptable value, to less than ½ of the peak and preferably approximately ⅓ of the peak.

There are many possibilities for the design of inductor 20. As mentioned, the outer core can be a flexible material highly filled with suitable ferrite to give flexibility and long length lc so that it can represent an actual spark plug wire, especially in the case of one coil-per-pug-ignition. Or one can include an extra layer of magnetic material adjacent to one of the cores which is absorptive in the high frequency range (30 to 300 MHz) to provide dual attenuating action to reduce W(lf) and W(hf), as per FIG. 3. Or the outer magnetic layer 23 can be absent for lesser attenuation. Or the inductor can be non-cylindrical as long as the objectives of reducing the voltage difference across the last bays is met.

Figure 7:
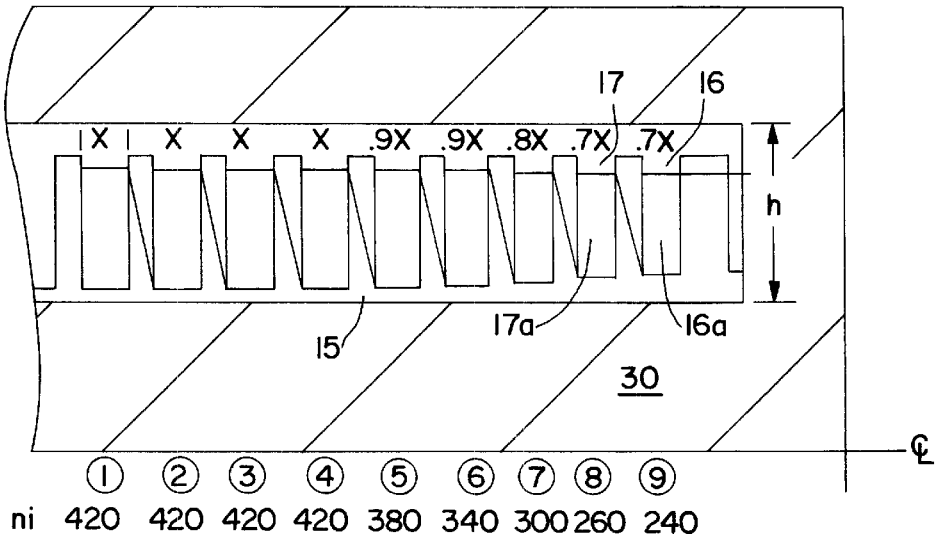
FIG. 7 depicts a partial side-view of a bobbin showing the last nine bays, with the last few bays having narrower bay winding window widths accompanied by significantly lower number of turns per bay.

For the design of the bobbin of the ignition coil is shown a preferred design in partial side-view format in FIG. 7, of a bobbin with nine bays, with the last two bays at the high voltage end numbered according to that of FIG. 5*a*. In this figure are shown certain preferred features: 1) a deeper than normal bay of height "h" (of the laminated core 30 indicated) so that a high voltage can be sustained from top to bottom of the height across which the voltage ΔVsn is imposed; 2) smaller bay widths for the last few bays which are accompanied by significantly lower number of turns per bay ni, indicating by way of example 240 and 260 turns for bays 16 and 17 respectively versus 420 for the first few bays; and 3)somewhat thicker flanges (bay separators) for the last one to three bays. Note that the term "x" indicates the bay width, so that the reduction of "x" to 0.9x. 0.8x, and 0.7x indicate possible reduction of bay widths for the last few bays. The bobbin structure shown is approximately twice scale of a bobbin for a single coil, high energy, high efficiency CD distributor ignition system, as are the number of turns ni, taken as approximations, i.e. within ±25. A preferred embodiment is a coil based on two ⅝ LW laminated E-cores, Thomas & Skinner designation, providing a winding window length of 2 ⅝" with side-by-side windings with between 45 and 55 turns for the primary winding and a secondary to primary wire turns ratio Nt between 50 and 70.

Figure 8A:
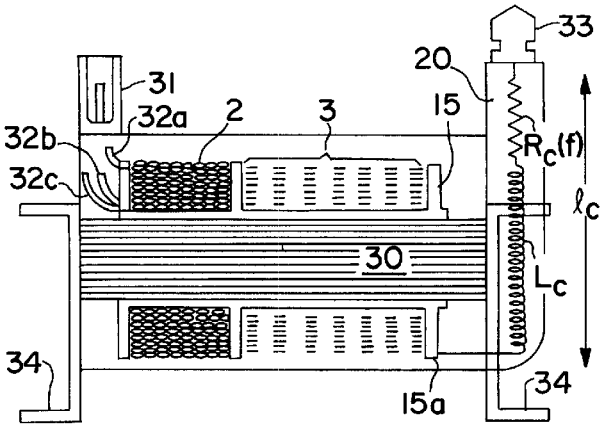
FIG. 8*a* shows a reduced scale partial side view of such an ignition coil of the CD type ignition with side-by-side primary and secondary windings with an end-effect inductor shown in circuit component form contained in the high voltage tower
Figure 8B:
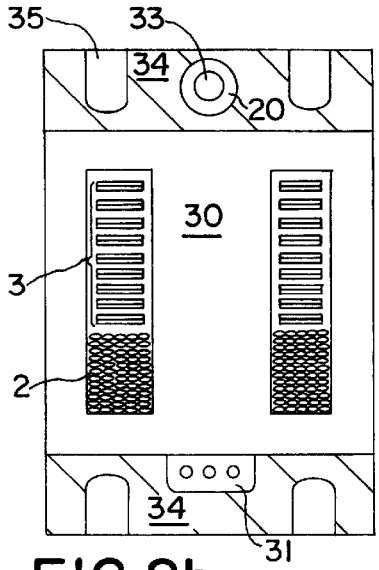
FIG. 8*b* shows a partial top view of the coil of FIG. 8*a*.

FIG. 8*a* shows a reduced scale partial side view of such an ignition coil (only seven bays of secondary turns 3 shown in this view), and FIG. 8*b* shows a partial top view (with nine bays indicated in this case). The fewer bays are more practical for free-standing windings made with a universal winding machine, and the larger number of bays are more practical for the more conventional segmented bobbin as per FIG. 7. Shown is a connector 31 (to which the primary wires 32*a*, 32*b*, and the secondary lead wire 32*c* are connected) oriented in the vertical orientation as is the high voltage terminal 33 vertical instead of horizontal. This is to provide a longer length lc for the imbedded end-effect inductor 20, shown in the circuit format of FIG. 6*a*, which connects from the bottom end 15*a* of the bobbin and traverses the full vertical span to the high voltage terminal 33. In both FIGS. 8*a* and 8*b* are indicated a primary winding 2 of turns Np of approximately 50. Simple U-channel combined heat sinks and mounting structures 34 (with mounting slots 35) are indicated at the two ends of the coil.

Figure 9A:
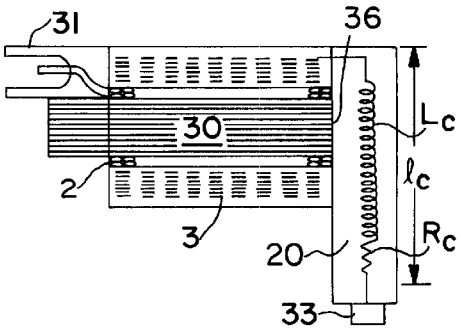
FIGS. 9*a* and 9*b* show approximately to-scale side and top view drawings of a preferred embodiment of the open-E coil structure of the 42 volt based inductive ignition with the end-effect inductor shown in circuit component form contained in the high voltage tower of FIG. 9*a*.
Figure 9B:
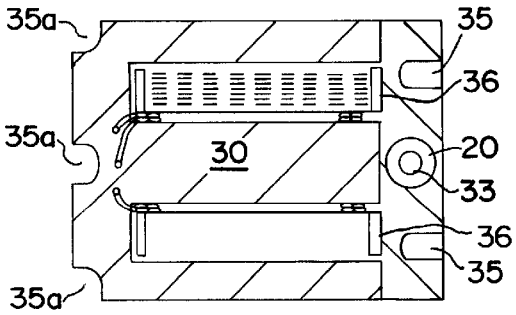

FIGS. 9*a* and 9*b* show approximately to-scale side and top view drawings of a preferred embodiment of the open-E coil structure of the 42 volt based inductive ignition already cited. These coils are concentrically wound, with the primary turns 2 (ideally two layers) wound on the inside, and the secondary 3 turns on the outside (shown as nine separate bay windings). These coils are suitable for the emerging one-coil-per-plug passenger vehicle applications where the coil is mounted in the vicinity of the spark plug, such as on top of the valve cover or between the valve covers for double overhead cam (OHC) engines. Imbedding of the end-effect inductor 20 at the high voltage end of these coils is ideal since the space is available at the open end 36, and moreover since that space (at the open end 36 of the laminations 30) must be filled so as to prevent the open end 36 from being placed adjacent to a large metal plate. The end-effect inductor 20 is shown spanning the entire height of the coil body (FIG. 9*a*) and extending down as far as is practical towards the spark plug (length lc). Two mounting holes 35 are preferably encapsulated adjacent to the inductor 20, and cut-outs 35*a* may be provided at the opposite lamination end as indicated. The entire unit is preferably encapsulated with highly filled (alumina) epoxy for best use of space and minimum possibility for corona. In FIG. 8*a*, the end-effect inductor is shown in its circuit form of FIG. 6*a*.

Another advantage of these coils is the open end structure which results in a lower output capacitance Cs and hence lower peak discharge current which allows for smaller diameter core parts for the end-effect inductor Lend to minimize the voltage difference ΔVsn.

For extracting the heat from the coil core and windings, which is more important given that the outside of the laminations are largely encapsulated, and to minimize epoxy expansion with temperature, preferably low expansion and high thermal conductivity material, such as alumina, is used for the epoxy filler, except in larger percentages than typical to bring the expansion coefficient below 30 ppm, as discussed. This requires significant preheating of the encapsulant prior to the coil encapsulation.

The response time Tri of the coil bays depends in substantial part on the number of turns in the bay. For the 42 volt based inductive ignition coil of the cited patent application, the number of secondary turns is significantly higher, typically 4,500 to 5000, versus the 3,200 for the CD system disclosed with reference to FIG. 7. For conventional inductive ignitions, the secondary turns Ns are even higher, typically much higher than 5,000. By using a lower primary turns of 50 to 60 for the 42 volt based system and higher voltage switches S (switch 10 of FIG. 1), i.e. 600 to 900 volt IGBT switches, then the turns ratio Nt can be lowered to as low as 60 even for a high output voltage of 36 kV, and the secondary turns reduced to 4,000 or under, which with a minimum of nine bays and the fewer turns per bay for the last bays, will further reduce the response time Tri of the last few bays and reduce the end-effect over-voltage.

Figure 10A:
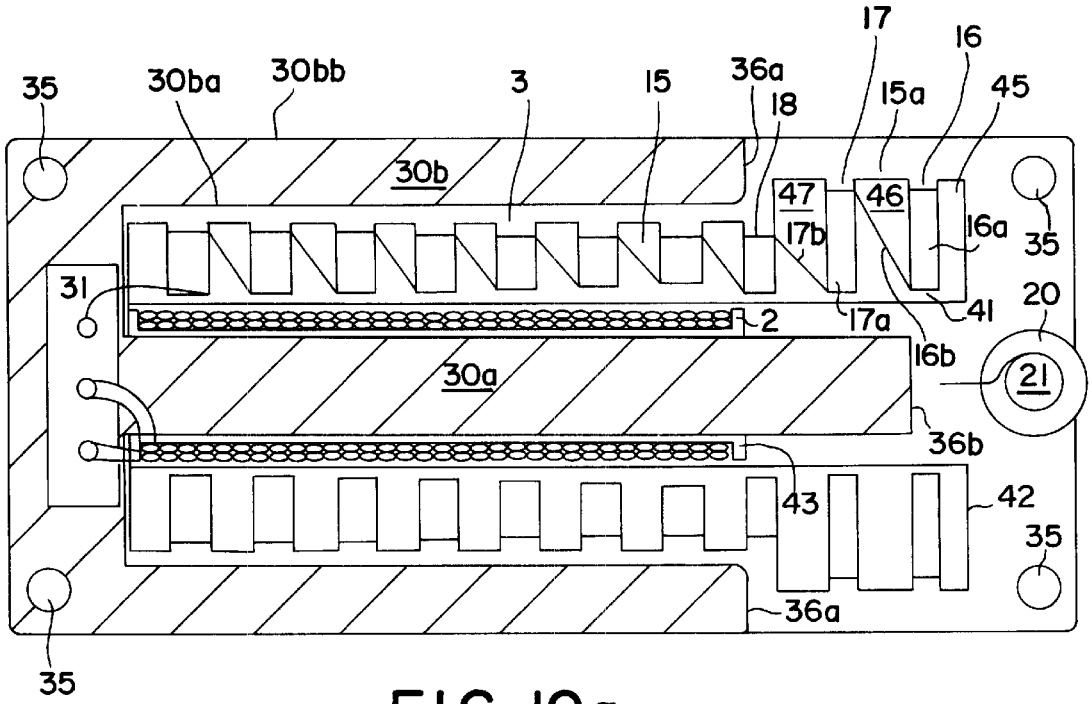
FIG. 10*a* is an enlarged, not-to-scale top view of the open-E coil of the 42 volt based inductive ignition showing details of the primary and secondary winding bobbins wherein the secondary bobbin extends beyond the open end of the open-E magnetic core.

FIGS. 10*a* is an enlarged, not-to-scale top view drawing and 10*b* is an approximately to-scale side view drawing of a preferred embodiment of the open-E coil structure of the 42 volt based inductive ignition. These coils are concentrically wound, with the primary turns 2 (preferred two layers shown) wound on the inside, and the secondary 3 turns on the outside (shown as 10 separate bay windings). These coils are similar to that disclosed in FIGS. 9*a*, 9*b* but improved by having the secondary bobbin 15 extending beyond the core open end 36*a*, defined by the outer legs 30*b* of the E-core. The bobbin extension 15*a* is made of three bays 16, 17, 18 shown in this case with three associated flanges 45, 46, 47. Like numerals represent like parts with respect to the previous figures.

As shown in FIG. 10*a*, the bobbin extension has a larger outer diameter which extends beyond the inner edge 30*ba* of the outer core leg and below the outer edge 30*bb* of the core leg 30*b*. As a result the last two bays 16 and 17 are deeper both because of the larger diameter and because of the thinner flange thickness 41 needed at the bottom. The result is that the voltage across the winding in each of these bays is spread over a greater length. Also, the bays are made substantially thinner, about one half of the average of the other bays to accommodate fewer turns of the average turns per bay to reduce the end-effect voltages discussed with reference to FIG. 7. The flanges 45, 46, 47 are thicker to also accommodate the higher voltage across them. The center leg of the core is shown extending beyond the end 36*a* of the outer legs and below the end 42 of the bobbin. In this figure, are shown preferred 58 turns of primary wire 2 (between 50 and 70 is preferred) in the preferred two layer winding made of preferred 17 to 20 AWG wire for a coil of stored energy 100 mJ or greater. The length of the primary bobbin 43 is approximately the same as that of the outer core legs 36*a*. A preferred turns ratio N of 60 to 80 is assumed, if practical.

Figure 10B:
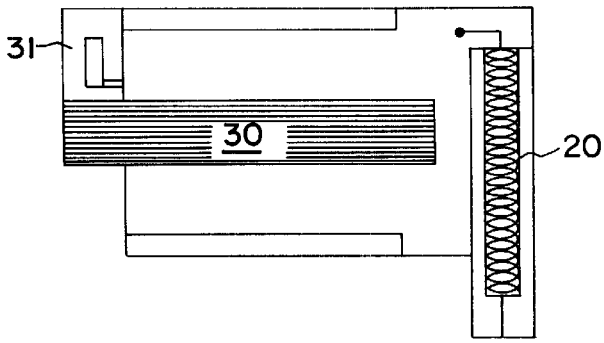
FIG. 10*b* is an approximately to-scale side view drawing of the coil of FIG. 10*a* showing a preferred cylindrical, single layer inductor contained in the high voltage tower.

The end-effect inductor is assumed to be cylindrical with a cylindrical core of preferable diameter ⅜ inch with a single layer winding 20 shown with reference to FIG. 10*b* imbedded at the open end as shown, spanning the entire height as shown with reference to FIG. 9*a*. The inductance of the end-effect inductor is typically 1 to 4 mH.

It is possible to produce a segmented bobbin by means of a universal winding wherein the space between the bays is air, i.e. the windings are free standing, and the same principles disclosed herein would hold for such a winding, which the bay separation becoming filled with epoxy for an encapsulated coil.

Since certain changes may be made in the above circuits and coil design without departing from the scope of the invention herein disclosed, it is intended that all matter contained in the above description, or shown in the accompanying drawings, shall be interpreted in an illustrative and not limiting sense.

What is claimed is:

1. An ignition system with a high efficiency ignition coil usable with any type of high voltage ignition system from the class of capacitive and inductive and hybrids of these for producing an ignition spark in a spark gap, with a primary winding of turns (Np) and secondary winding of turn (Ns), and turns ratio N (N=Ns/Np), wherein the secondary winding is wound on a segmented type bobbin with multiple bays separated by radial flanges, the coil including an end-effect inductor of inductance (Lc) located between the high voltage end of the coil winding and the spark gap, the inductor having core material which is electrically lossy with resistance (Rc(f)) at a frequency associated with the oscillation between the coil output capacitance (Cs) and the inductor following spark breakdown, such that immediately following spark breakdown, the voltage across each of the windings in the last few bays at the high voltage end is substantially reduced from the value it would have without said inductor.

2. An ignition system as defined in claim 1 wherein said end-effect inductor has an inductance between 0.5 and 5 mH and high magnetic core loss at 1 MHz frequency.

3. An ignition system as defined in claim 1 wherein said end-effect inductor has an inductance substantially equal to the inductance of the winding in the last high voltage bay of the secondary winding.

4. An ignition system as defined in claim 3 wherein said end-effect inductor has an inductance equal to the inductance of the last bay.

5. An ignition system as defined in claim 1 wherein said inductor is elongated cylindrical inductor with a single layer of wire wound over the core.

6. An ignition system as defined in claim 1 wherein the inductor is integrated into the coil.

7. An ignition system as defined in claim 6 wherein the inductor is placed in the high voltage tower.

8. An ignition system as defined in claim 1 wherein the coil secondary segmented windings are free-standing windings with no flanges in between.

9. An ignition system as defined in claim 1 wherein the number of end bays-windings affected by the end effect inductor is up to one third of the total number of bays.

10. An ignition system with a high efficiency ignition coil usable with any type of high voltage ignition system from the class of capacitive and inductive and hybrids of these for producing an ignition spark, with a primary winding of turns (Np) and secondary winding of turns (Ns), and turns ratio N (N=Ns/Np), wherein the secondary winding is wound on a segmented type bobbin with multiple bays separated by radial flanges, wherein the last few bays have narrower widths than the average bay width for winding the wire and are separated by flanges of greater thickness than the average thickness of the flanges.

11. An ignition system as defined in claim 10 wherein the coil is of the inductive ignition open-E structure with the high voltage bobbin extending beyond the open of the core and wherein the extending bobbin portion has a larger diameter than the interior part of the bobbin.

12. An ignition system as defined in claim 11 wherein the coil includes an inductor between the high voltage end and the spark gap.

13. An ignition system as defined in claim 11 wherein the coil has a primary turns (Np) of approximately 60 wound in a two layer winding.

14. An ignition system as defined in claim 11 wherein the coil has a turns ratio N between 50 and 70.

15. An ignition system as defined in claim 11 wherein the core of the coil has a center leg longer than the outer legs of the E-core.

16. An ignition system as defined in claim 10 wherein the coil includes an inductor between the high voltage end and the spark gap.

* * * * *